US006305979B1

(12) United States Patent
Ko

(10) Patent No.: US 6,305,979 B1
(45) Date of Patent: Oct. 23, 2001

(54) LOWER PROFILE MICRO CONNECTOR ASSEMBLY

(75) Inventor: David Ko, Tso-Chin, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/579,956

(22) Filed: May 26, 2000

Related U.S. Application Data

(63) Continuation-in-part of application No. 06/139,363, filed on Jul. 9, 1999, now Pat. No. 9,350,942.

(51) Int. Cl.[7] ..... H01R 9/05
(52) U.S. Cl. ..... 439/579; 439/695; 439/697
(58) Field of Search ..... 439/579, 492, 439/497, 499, 660, 595, 874, 695, 697

(56) References Cited

U.S. PATENT DOCUMENTS

| | | | | |
|---|---|---|---|---|
| 4,169,650 | * | 10/1979 | Schweizer | 439/579 |
| 4,365,856 | * | 12/1982 | Yaegashi et al. | 439/579 |
| 4,550,971 | * | 11/1985 | Gentric | 439/697 |
| 4,682,840 | * | 7/1987 | Lockard | 439/874 |
| 4,993,968 | * | 2/1991 | Guletsky et al. | 439/579 |
| 5,026,304 | * | 6/1991 | Furrow | 439/695 |
| 5,085,596 | * | 2/1992 | Bowen et al. | 439/497 |
| 5,241,135 | * | 8/1993 | Fetzer | 439/579 |

FOREIGN PATENT DOCUMENTS

| | | | | |
|---|---|---|---|---|
| 3733070 | * | 4/1989 | (DE) | 439/579 |

* cited by examiner

*Primary Examiner*—Gary F. Paumen
(74) *Attorney, Agent, or Firm*—Wei Te Chung

(57) ABSTRACT

A micro coaxial cable connector assembly for contacting with a mating electrical connector includes a front and a rear housing members, a cable set with a number of cables, and a number of contacts. The front and rear housing members are efficiently and durably retained together by the cooperation between a pair of channels and corresponding latch portions thereof and by the interference fit of first retention sections and second retention sections of the contacts within a number of grooves and the passageways of the front and rear housing members, respectively. The cable set consists of juxtaposed cables each having at least a signal segment and a grounding segment, and a grounding bar formed by two plates soldered to the grounding segments of the cables. Each passageway of the rear housing member is equipped with an orientating device for convenience in soldering the signal segment of the cable to the tail section of the corresponding contact. The front housing member includes improved structure that reliably urges and partially encloses contact sections of the contacts, thereby protecting the contact sections and ensuring secure engagement of the contact sections with contact elements of a mating connector.

1 Claim, 21 Drawing Sheets

LOWER PROFILE MICRO CONNECTOR ASSEMBLY

CROSS-REFERENCED APPLICATION

This is a continuation-in-part of U.S. Pat. No. 6,139,363 issued on Oct. 31, 2000.

BACKGROUND OF THE INVENTION

1. Field of the Invention

The present invention relates to a micro connector assembly for link with a remote micro coaxial cable, and particularity to a micro connector assembly for electrical and mechanical contact with an external mating connector.

2. The Prior Art

In a conventional micro connector as introduced in U.S. Pat. No. 5,871,369 and Japanese Patent Publication No. 09-055243, a plurality of conductive cores of a flat cable are respectively fitted into several notches defined inside a main body of the connector. An elongated contact bar composed of an insulating material is then placed inside a groove of the main body defined perpendicular to a longitudinal axis of each notch thereby locating above the conductive cores in perpendicular relationship. Eventually, an insulative cover is restrainedly attached above the main body to press down the conductive cores via the contact bar. Thus, the conductive cores each relatively deflects down a spring contact arm of one of the contacts in a main body of the connector thereby establishing electrical connection between the cable and the contacts.

However, such a said connector has poor mechanical connection with the cable because of the absence of an efficient horizontal retention means to prevent the separation of the cable from connector or the conductive cores of the cable from cable after action of an excessive withdrawing force thereon. Furthermore, during the process of the moveable installation of the cover within the main body, a permanent deformation may happen in either of the spring contact arms due to improper operation. The minimized dimension and flexibility of the conductive cores will increase difficulty and inconvenience of the assembly with the corresponding notches of the main body or the poor engagement with the contact arm under the absence of an orientation means thereon.

Another conventional design on the micro type connector like Japanese Patent Publication Nos. 10-321314 and 10-255921 introduces that a cable holder of the connector defines a row of U-shaped grooves at a front end for reception of the corresponding conductive cores of the coaxial cable therein. When the grooves of the cable holder are respectively fitted and inserted between a tuning fork type tips of the corresponding contact, the upper and lower side tips of the contacts are brought to press down the conductive cores on one side/reversed sides of the U-shaped grooves. However, the fork type tips of the contact or the conductive cores are easily damaged or permanently deformed due to tight fit therebetween resulting from restriction of a housing where the contacts are received. The tight fit is still insufficient to firmly retain the cable holder with the housing, especially in exercise of an excessive full force on the cable.

SUMMARY OF THE INVENTION

Accordingly, one object of the present invention is to provide an improved micro connector assembly for easily and firmly linking with a plurality of micro coaxial cables.

Another object of the present invention is to provide an orientation means formed within several passageways of a rear housing member of the connector so as to accurately and speedily placing a plurality of conductive cores within the corresponding passageways.

Another object of the present invention is to provide an improved micro connector assembly having improved structure for securely retaining contact sections of a plurality of contacts therein and enabling the contacts to reliably engage with contacts of a mating connector.

A further object of the present invention is to provide an assembly of a male connector and a female connector firmly linking with a plurality of micro coaxial cables.

To fulfill the above mentioned objects, according to several embodiments of the present invention, a micro coaxial cable connector includes a front and a rear housing members, a cable set with a plurality of cables, and a plurality of contacts. The front housing member includes a plurality of grooves horizontally extending therethrough and a pair of channels with swellings formed therein. Each contact consists of a contact section at a free end for electrical contact with the mating connector, a first retention section at a middle region, a tail section at an opposite end, and a second retention section formed on the tail section. The cable set consists of juxtaposed cables and grounding bar. Each cable includes a signal segment at a free end thereof and a grounding segment insulated from and adjacent to the signal segment. The grounding bar consists of an upper and lower conductive plates soldered to opposite surfaces of the grounding segment of each of the cables. The rear housing member defines a plurality of passageways, a pair of latch portions with bow sections, and a pair of spaced orientating walls adjacent to a rear portion of the passageways thereby constituting an elongated slot for receiving the grounding bar jointed with the cables therein. Each passageway further forms a pair of protrusions on opposite lateral walls thereof for cooperating with said second retention section of the contacts. An orientating raise is selectively disposed at a rear of each of the passageways to orient the signal segment of each of the cables in front-and-rear direction. The front housing member includes improved structure that reliably urges and partially encloses contact sections of the contacts, thereby protecting the contact sections and ensuring secure engagement of the contact sections with contact elements of a mating connector.

DETAILED DESCRIPTION OF THE PREFERRED EMBODIMENTS

Detailed reference will now be made to the preferred embodiments of the present invention.

Figure 1:
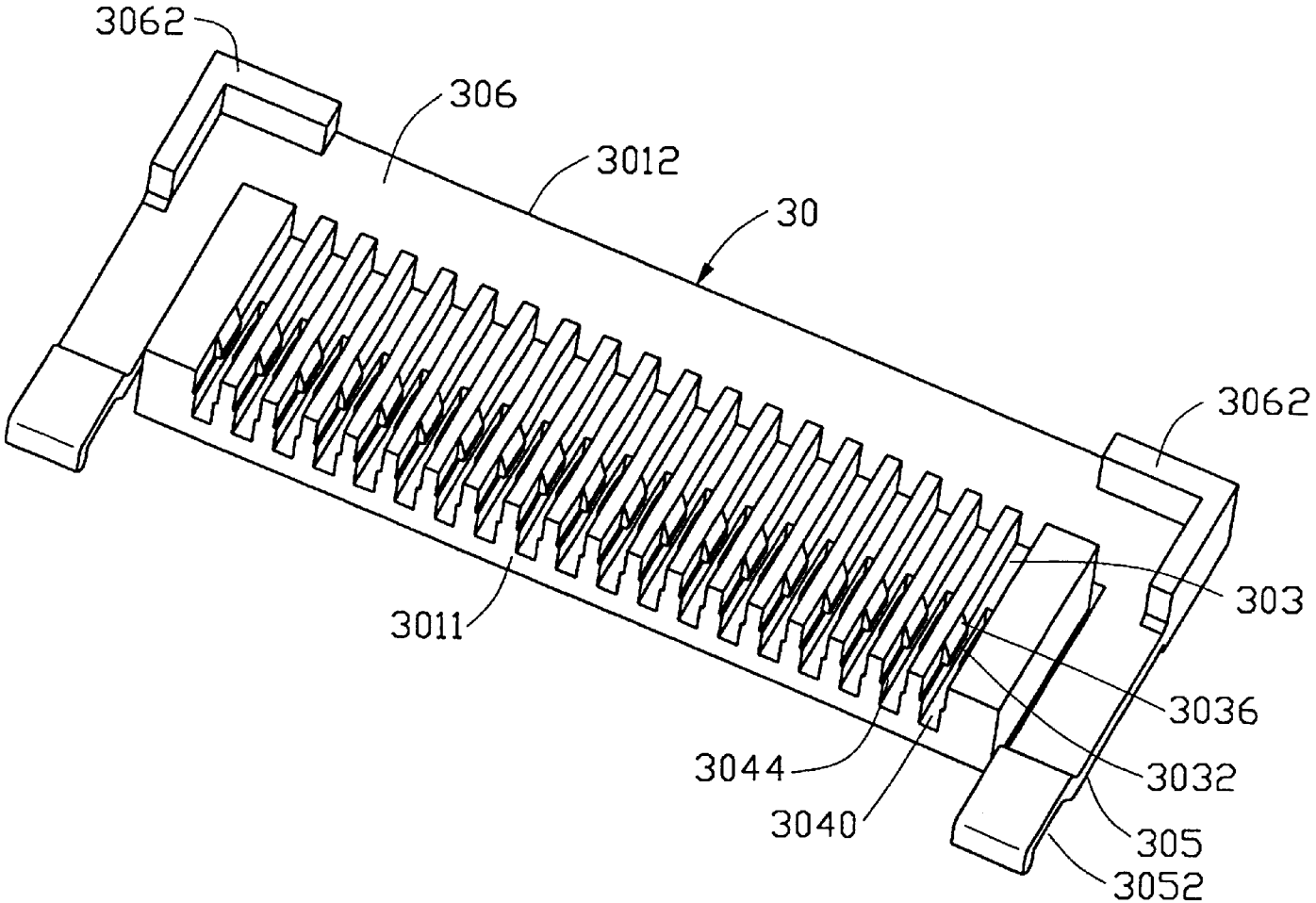
FIG. 1 is a front perspective view of a rear housing member of a micro connector assembly in accordance with a preferred embodiment of the present invention.
Figure 3:
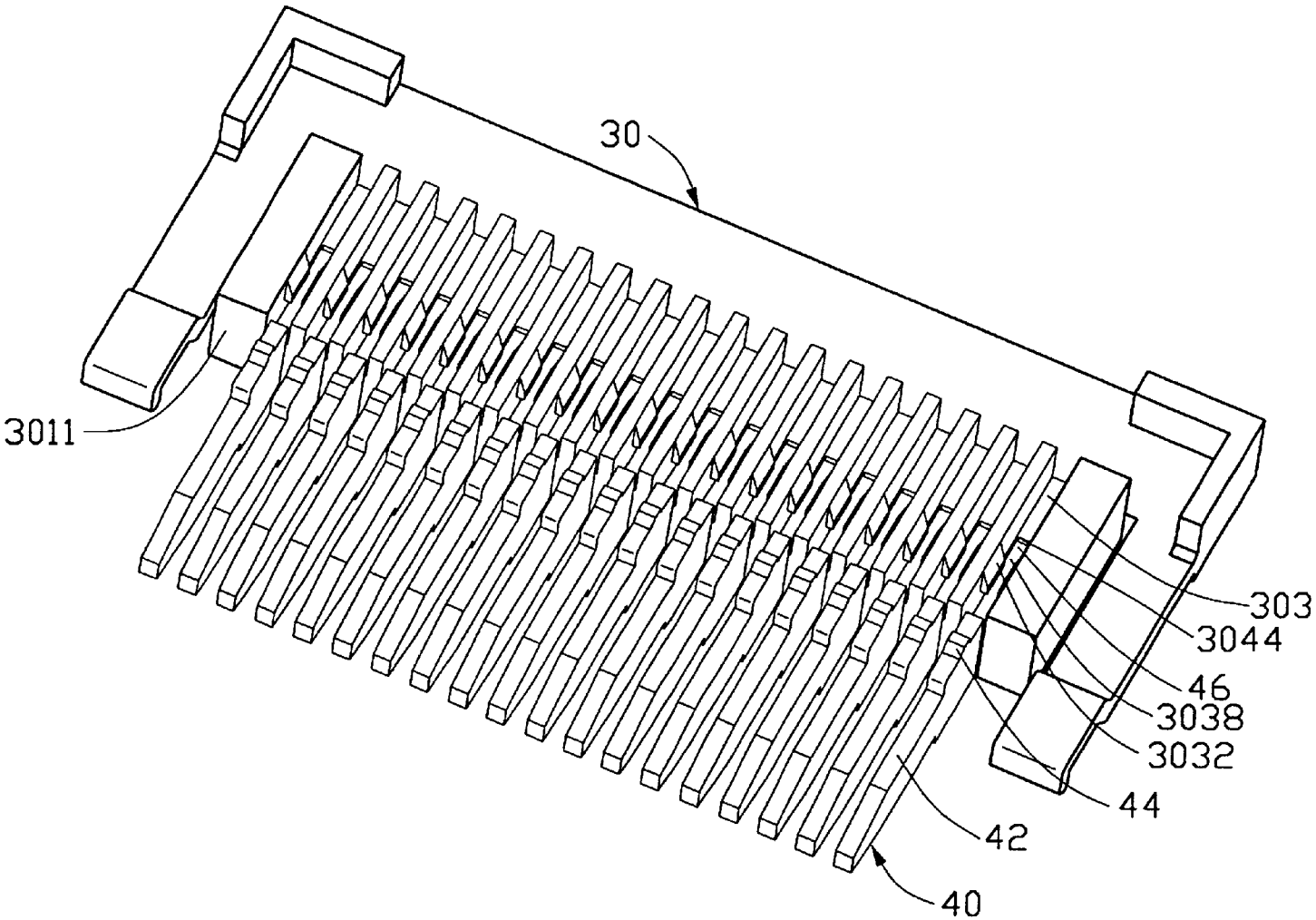
FIG. 3 is an assembled perspective view of the rear housing shown in FIG. 1 with the contacts shown in FIG. 2.

Referring first to FIG. 1, a rear housing member 30 of a micro coaxial connector assembly in accordance with a first embodiment of the present invention has opposite surfaces 3011, 3012 at a front-to-rear direction thereof. A row of spaced passageways 303 adjacent to the front surface 3011 are juxtaposed along a longitudinal axis of the member 30 and inward terminate at a predetermined position. Each passageway 303 is defined with opposite lateral walls, each lateral wall divided into an upper and lower portion, and a bottom wall located between the lower portions of the lateral walls. A cave 3044 adjacent to the front surface 3011 is defined on the bottom wall of each passageway 303. A pair of protrusions 3032 are formed at the upper portions of opposite lateral walls of each passageway 303 and horizontally extend toward each other to define a specific interval 3038 therebetween (FIG. 3). Each protrusion 3032 downwardly extends until terminating at an underside 3040 spaced apart from the cave 3044. A slope surface 3036 is formed at a top tip of each of the protrusions 3032. A pair of L-shaped orientating walls 3062 are respectively located at opposite corners adjacent to the rear surface 3012 to constitute an elongated slot 306 therebetween. A pair of latch portions 305 extend behind the front surface 3011 from said orientating walls 3062. A facing-down bow section 3052 is formed at a free end of each of the latch portion 305.

Figure 2:
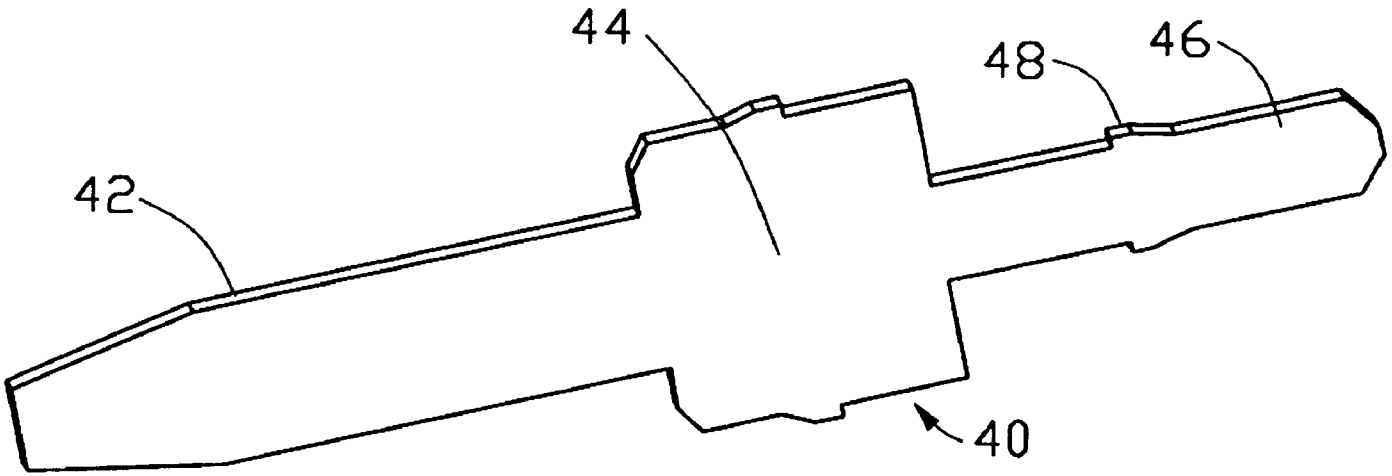
FIG. 2 is a front perspective view of a contact of the micro connector assembly according to the present invention.

Further referring to FIG. 2, a single tip type contact 40 consists of a contact section 42 at a free end thereof, a fins type first retention section 44 with a pair of barbs at a middle region thereof, and a tail section 46 with a barb-like second retention section 48 at opposed end thereof.

In subassembly shown in FIG, 3, the tail section 46 of the contacts 40 are respectively inserted horizontally between the cave 3044 and the protrusions 3032 of the corresponding passageways 303, via the front surface 3011 of the rear housing member 30. Further the second retention section 48 of each of the tail sections 46 is interference fitted with the underside 3040 of the protrusion 3032. Each of the contacts 40 exposes both the contact section 42 and the first retention contact 44 outside the front surface 3011 of the main body 30.

Figure 4:
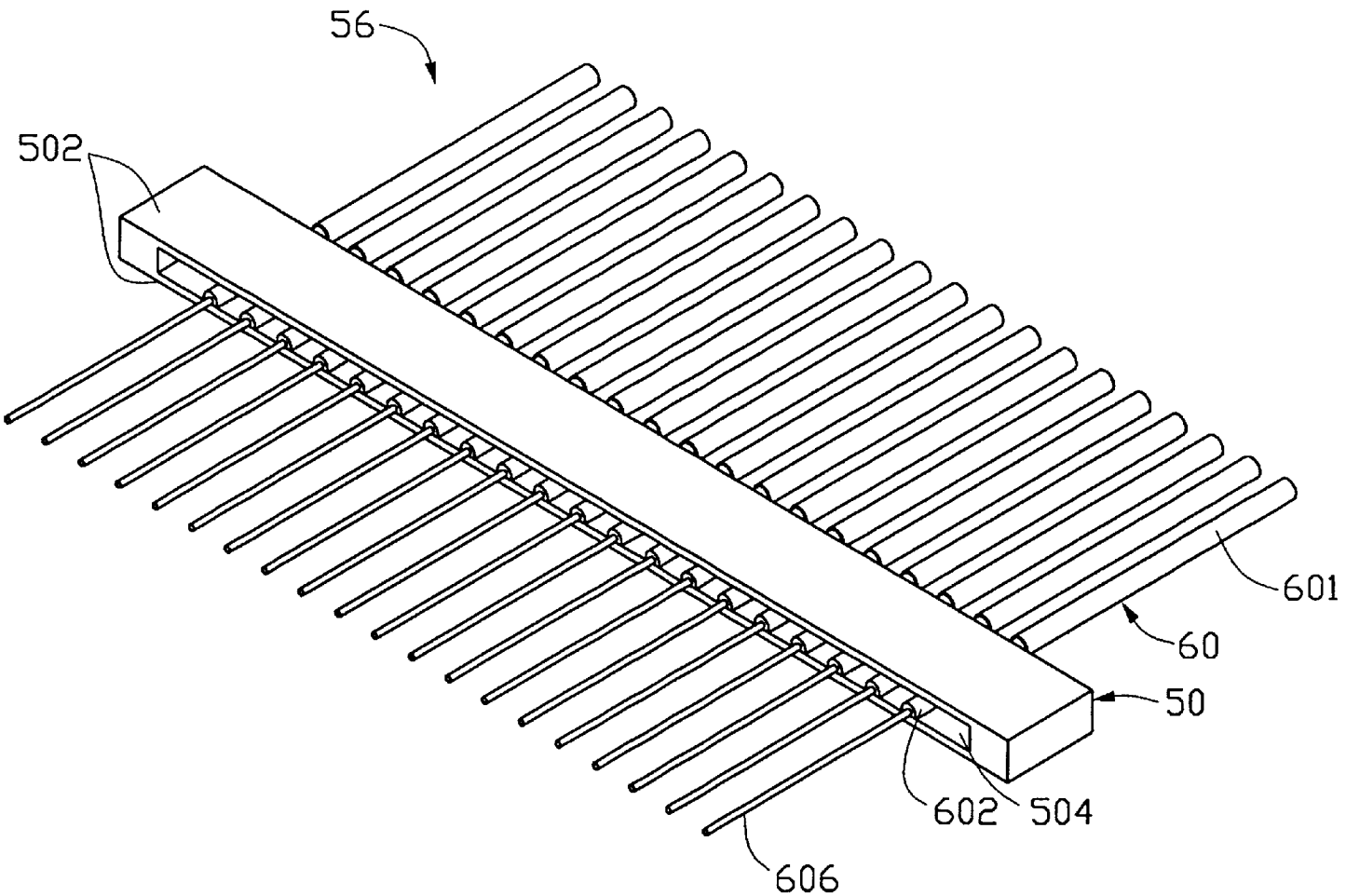
FIG. 4 is a front perspective view of a cable set of the micro connector assembly according to the first preferred embodiment of the present invention.

A micro coaxial cable set 56 as shown in FIG. 4 consists of a row of juxtaposed coaxial round cables 60 and a grounding bar 50. Each cable 60 is composed of a first insulative layer 601 at the outermost thereof, a conductive jacket layer 602 formed below the first insulative layer 601, a second insulation layer 604 (See FIG. 6) formed below the jacket layer 602 and a conductive core 606 at the innermost thereof.

The grounding bar 50 is defined with an upper and lower metal plates 502 fixedly jointed at opposite ends thereof and a crack 504 separating both plates 502 from each other. In subassembly of the cable 60 with the grounding bar 50, each cable 60 perpendicularly extends through the crack 504 of the grounding bar 50 and clamped between the plates. The outermost insulative layer of each cable 60 in part is stripped off to expose the jacket layer 602 as being a grounding segment of the cable 60. Then the grounding segment of each cable 60 are respectively soldered with the inner walls of the upper and bottom plates 502. The cable 60 in part is further stripped off to exposes the conductive core 606 as being signal segment which extends outside the grounding bar 50 and insulated from the grounding segment by the second insulative layer 604. However, it is noted that before the soldering process is exercised thereon, these cables 60 are fixed in position of defining a specific interval between each two cables 60 to meet the pitch of the contacts 40 by the way of applying an external tool. In consideration of the convenience of soldering process exercised between the contacts 40 and the cables 60, an indent or a plurality of compartment structure (not shown) can be designedly formed along a longitudinal axis of said inner walls of the plates 502.

Figure 5:
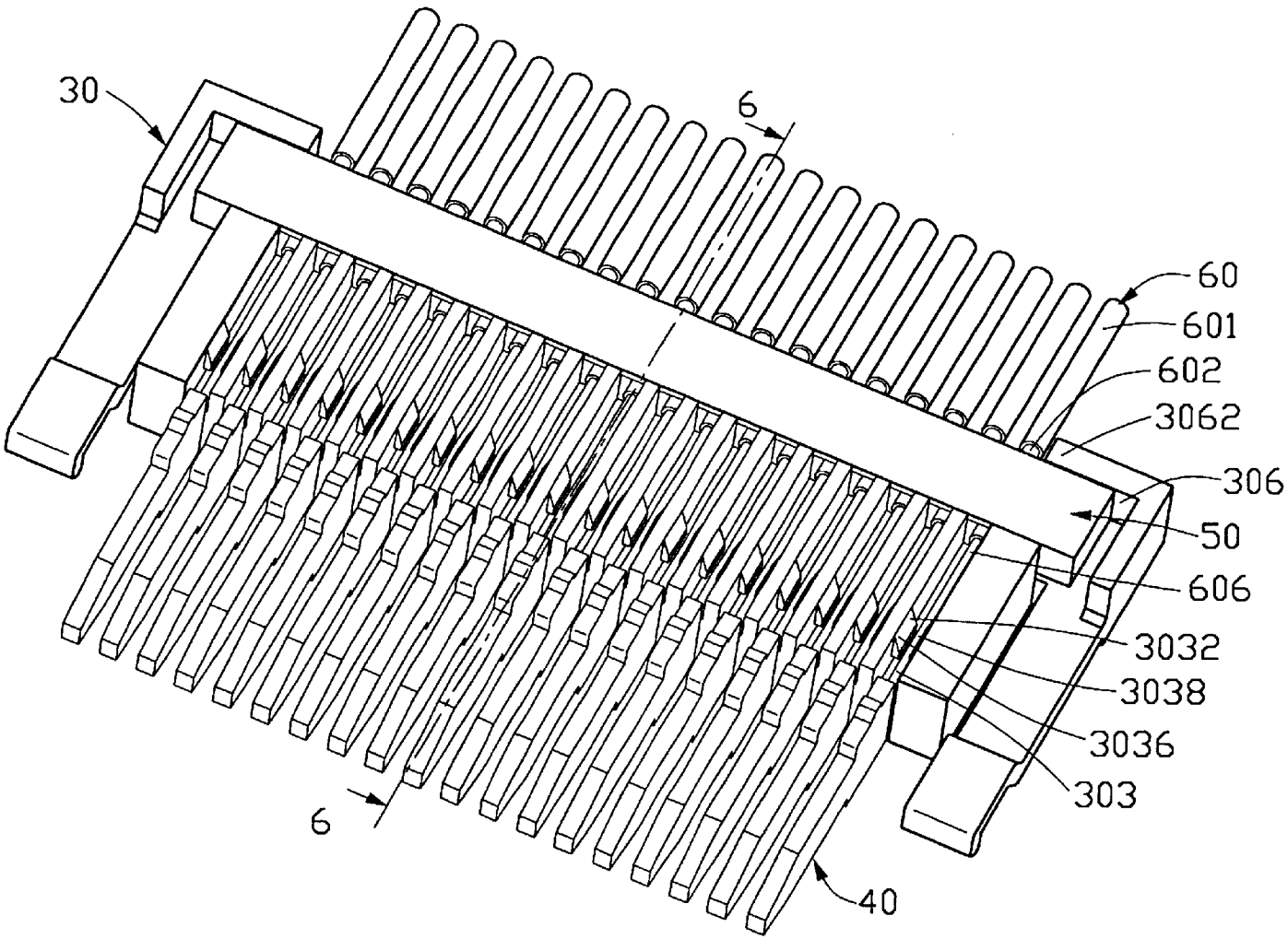
FIG. 5 is an assembled perspective view of the rear housing shown in FIG. 3 with the cable set shown in FIG. 4.
Figure 6:
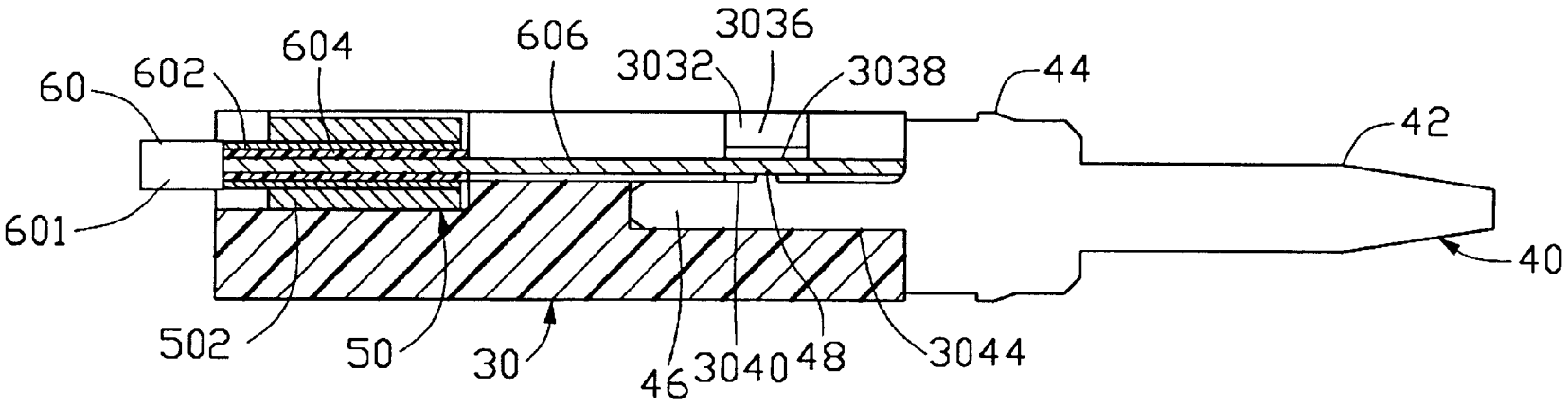
FIG. 6 is a cross-sectional view of the rear housing member taken along line 6—6 of FIG. 5.

In subassembly as shown in FIGS. 5 & 6, the grounding bar 50 of the cable set 56 is placed inside the slot 306 of the rear housing member 30 and restricted by the orientating walls 3062 from moving along a horizontal direction with respect to a surface of the rear housing member 30. One of opposite ends of each cable 601 rearward extends through the rear surface 3012 of the rear housing member 30 to link with an desired electrical device (not shown). Another end of the cable 601, a signal segment of exposing the conductive core 606, horizontally extends through the interval 3038 formed between the protrusions 3032 in the corresponding passageway 303 and above the tail section 46 of the contact 40 which is retentively received within the cave 3044 of the corresponding passageway 303. Then, a soldering process or a conductive adhesive is accurately exercised between the signal segment of the cable 60 and the tail section 46 of the contact 40 for enhancement of the electrical and mechanical connection therebetween.

As soon as the rear housing member 30 is assembled with the cable set 56, the signal segment of each cable 60 are accurately aligned with the passageways 303 because of being pre-soldered with the grounding bar 50 in the specific interval between each two adjacent cables 60 as mentioned above. By means of guidance of the slope surfaces 3036 of the protrusions 3032, the signal segment can be easily oriented within the interval 3038 between the protrusions 3032, almost equal to the diameter of the cores 606 for accurate and convenient soldering with the tail sections 46 of the contacts 40. It is noted that the opposite protrusions 3032 also are capable of restricting the melted flux from flowing out of the signal segment during the soldering process thereby raising the efficiency of soldering.

Figure 7:
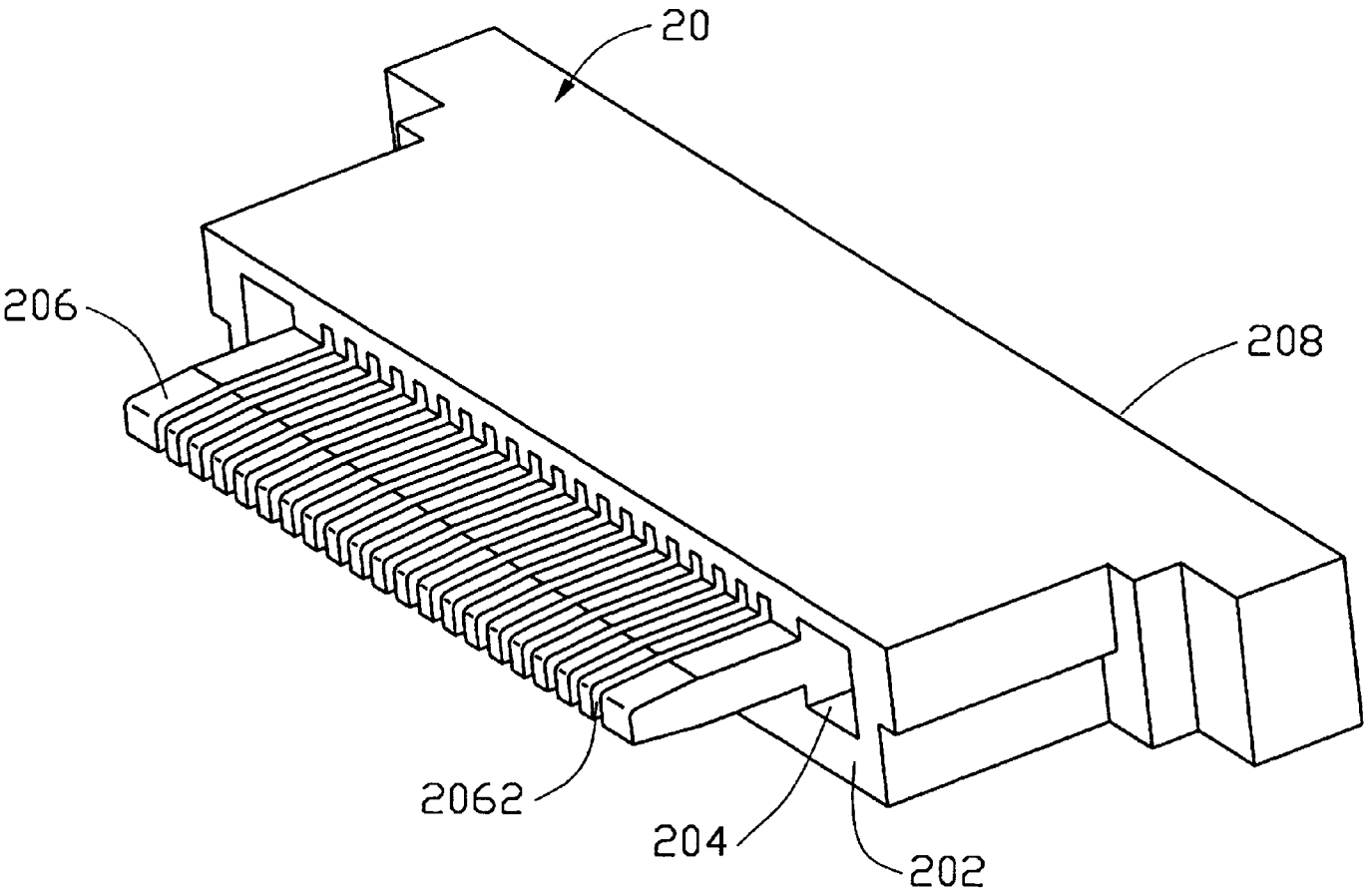
FIG. 7 is a front perspective view of a front housing member of the micro connector assembly according to the present invention.

Further referring to FIG. 7, a front housing member 20 includes a mating surface 202 for contact with an external mating connector (not shown), and a joint surface 208 opposite to the mating surface 202 for contact with said the rear housing member 30 as shown in FIGS. 5 & 6. A tongue portion 206 outwardly extend at a meddle region of the mating surface 202 for insertion into the mating connector. An opening (not shown) is defined on the joint surface 208 for entrance of the rear housing member 30. A plurality of grooves 2062 horizontally extends between a free end of the tongue portion 206 and the joint surface 208 along a front-to-rear direction. A pair of channels 204 formed at opposite lateral walls of the front housing member 20 horizontal extends through both surfaces 202 and 208. A swelling (not shown) vertically extends from a specific position of a bottom side of each of the channels 204.

Figure 8:
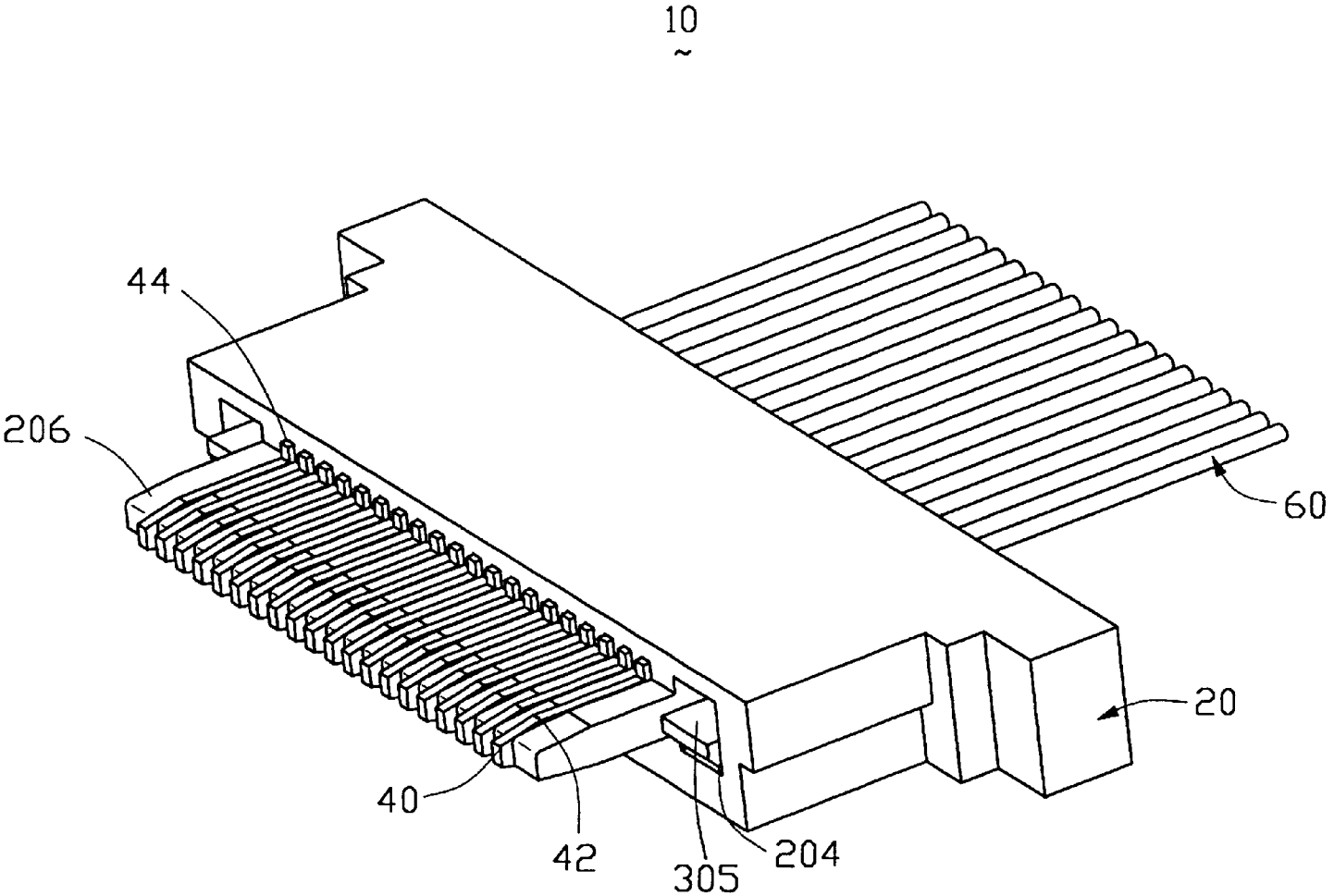
FIG. 8 is an assembled perspective view of the micro connector assembly with the front housing member shown in FIG. 7 and the rear housing member shown in FIG. 5.

In final assembly, the rear housing member 30 is inserted into the front housing member 20 from the opening of the joint surface 208 as shown in FIG. 8. The latch portions 305 of the rear housing member 30 are inserted within the channels 204 of the front housing member 20 and retained with the swellings in the channels 204 by the locking of the bow sections 3052 therewith. The contacts 40 disposed within the passageways 303 of the rear housing member 30 are respectively inserted into the corresponding grooves 2062 of the front housing member 20 and exposes the contact sections 42 outside the tongue portion 206 for electrical contact with the external mating connector. Each contact 40 is interference fitted with an upper wall of the corresponding groove 2062 by the barb-like first retention section 44 thereof.

In comparison with the prior arts that depend on the tight fit between the cables and the contacts thereof, the retention between the front and rear housing members 20 and 30 in accordance with the first embodiment of the present invention adopts the locking between the channels 204 and the latch portion 305, and the interference fit of the contacts 40 with the grooves 2062 and passageways 303. Thus, the mechanical and electrical connection between the cables 60 and the contacts 40 or between the front and rear housing members 20 and 30 can achieve higher performance than those of the prior arts.

Figure 9:
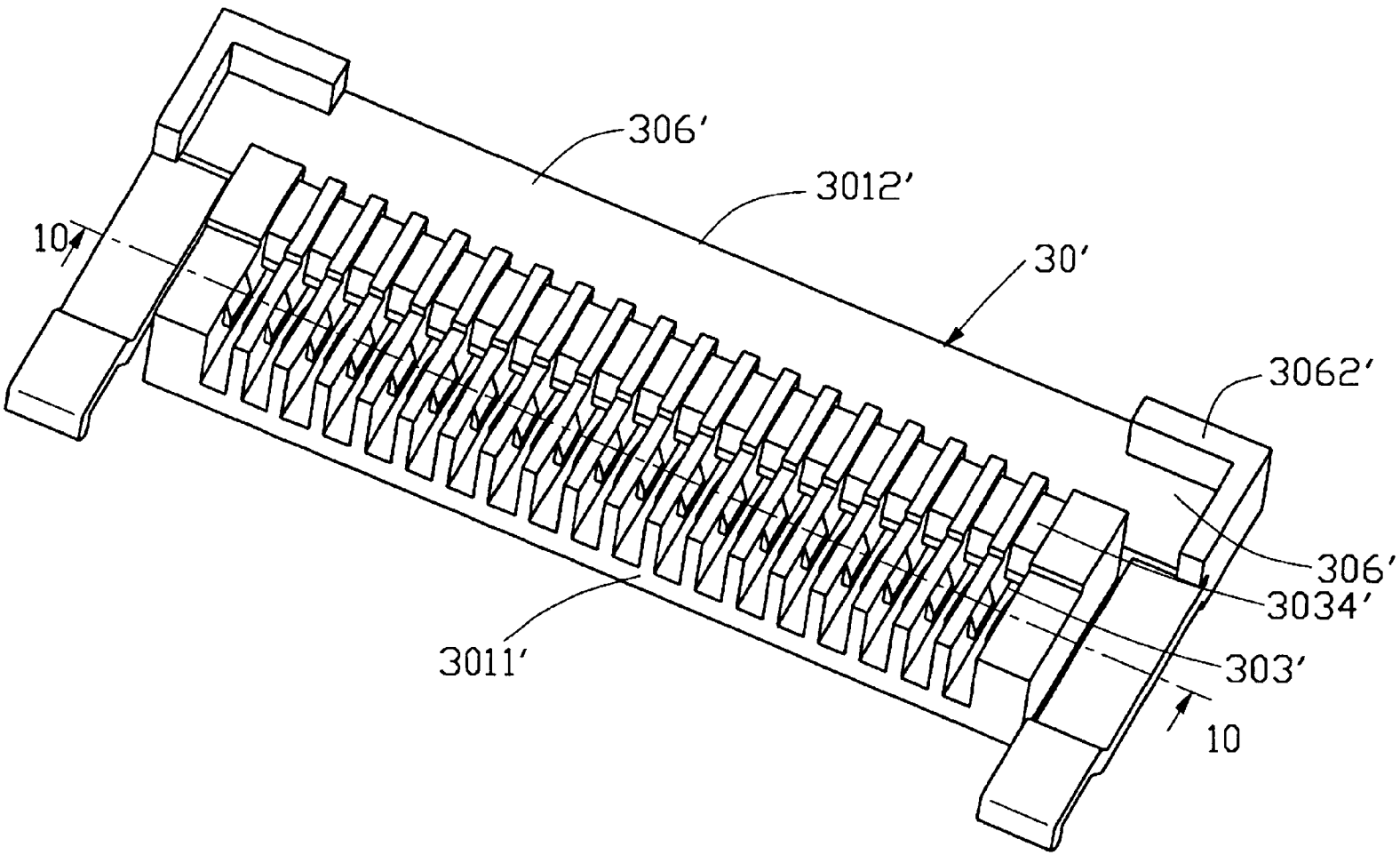
FIG. 9 shows a second embodiment of a rear housing member according to the present invention.
Figure 10:
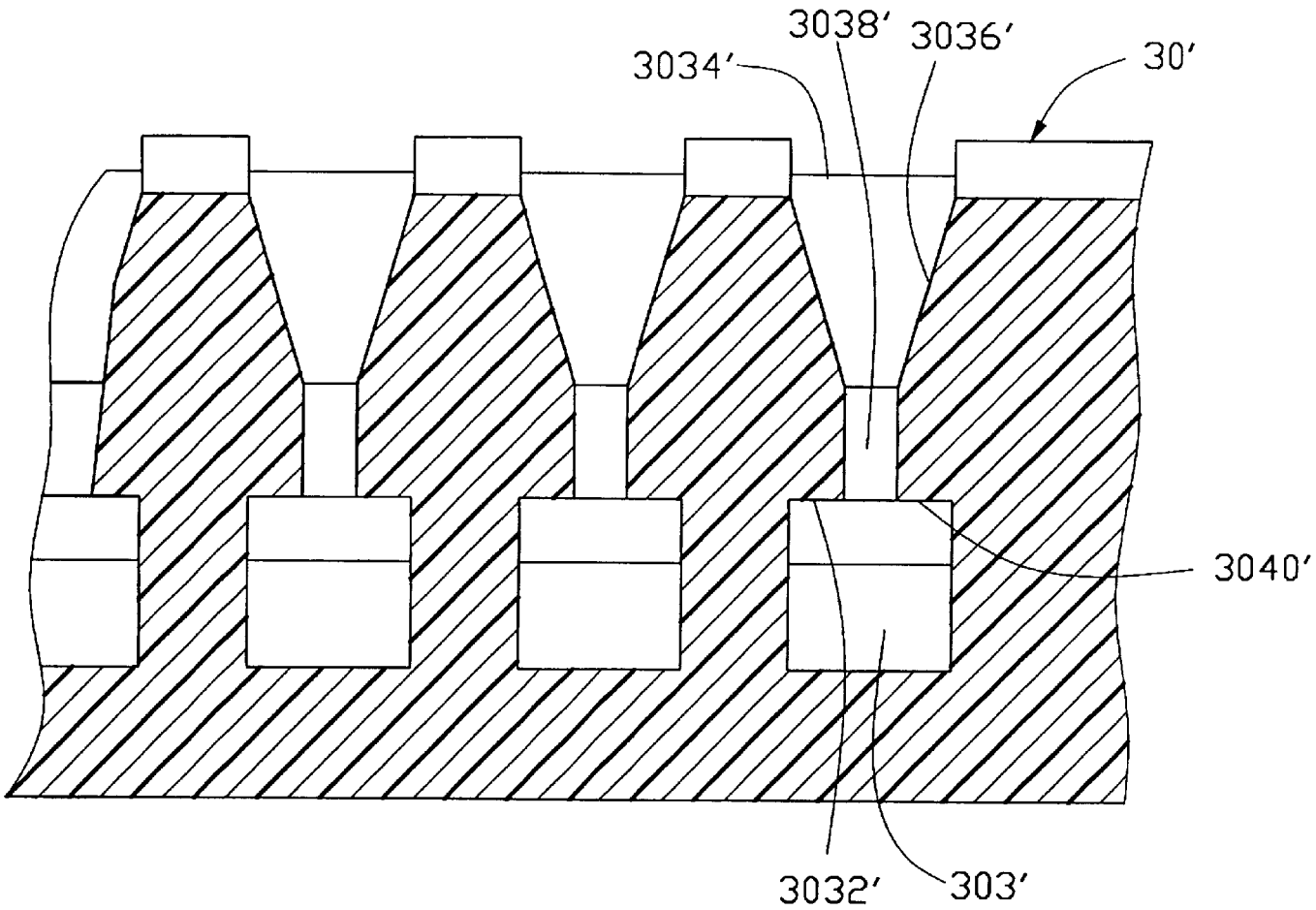
FIG. 10 is a partly cross-sectional view of the rear housing member taken along line 10—10 of FIG. 9.
Figure 11:
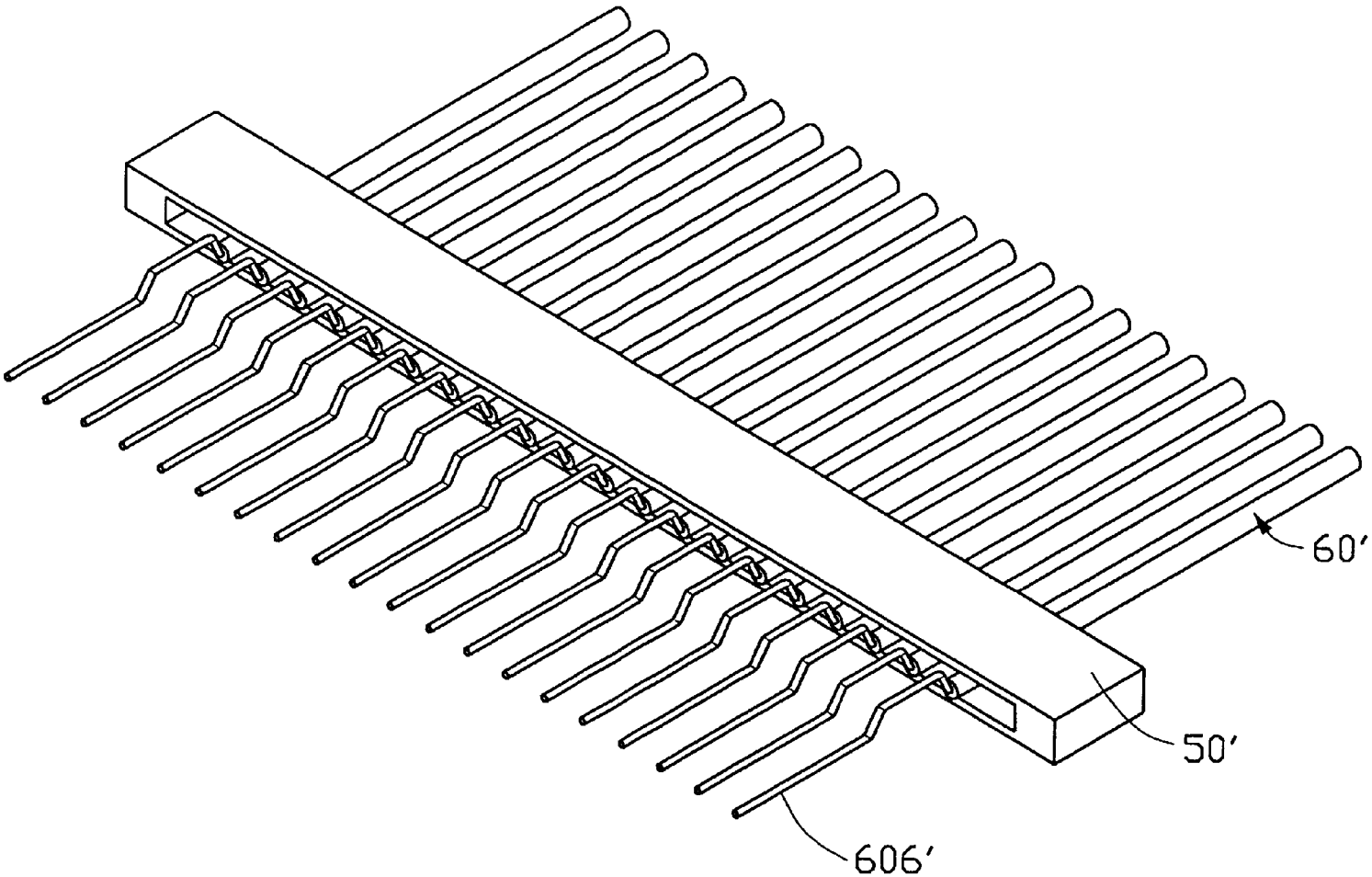
FIG. 11 is a front perspective view of a cable set of the micro connector assembly according to the second embodiment of the present invention.
Figure 12:
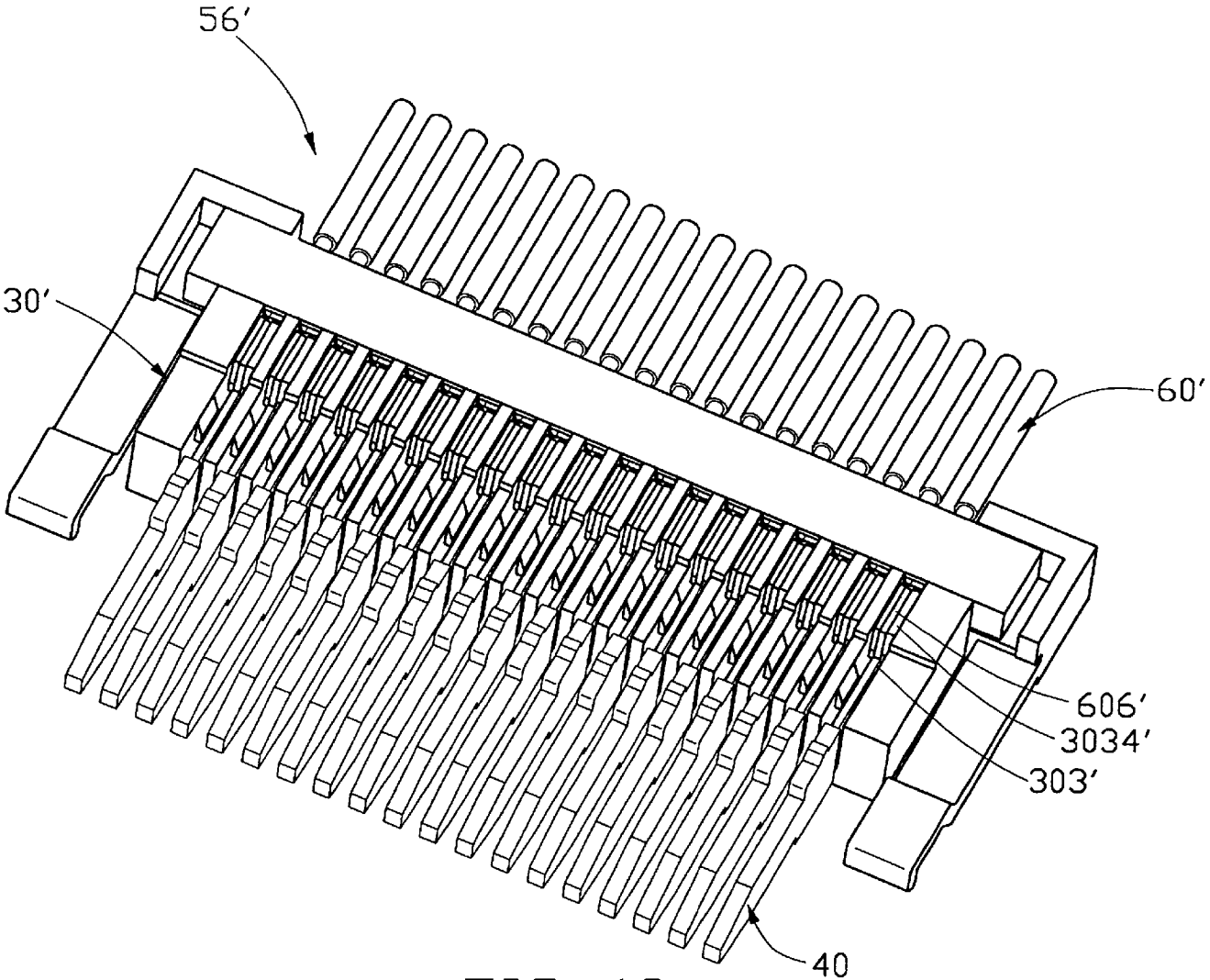
FIG. 12 is an assembled perspective view of the micro connector assembly with the rear housing member shown in FIG. 9 and the cable set shown in FIG. 11.

A second embodiment of the present invention as shown in FIGS. 9 & 10 has an orientating raise 3034' in comparison with the first embodiment. The orientating raise 3034' is formed at a rear end of each of the passageways 303' for orientation of the cable at the passageways 303'in a front-to-rear direction, especially upon a larger fitting tolerance between the grounding bar 50' (See FIG. 11) and the slot 306" of the rear housing member 30'. Relatively, a rear portion of the signal segment of the cable 60' that exposes the conductive core 606' as shown in FIG. 11 is shaped to the same contour as the orientating raise 3034' for the above-mentioned orientation as shown in FIG. 12.

Figure 13:
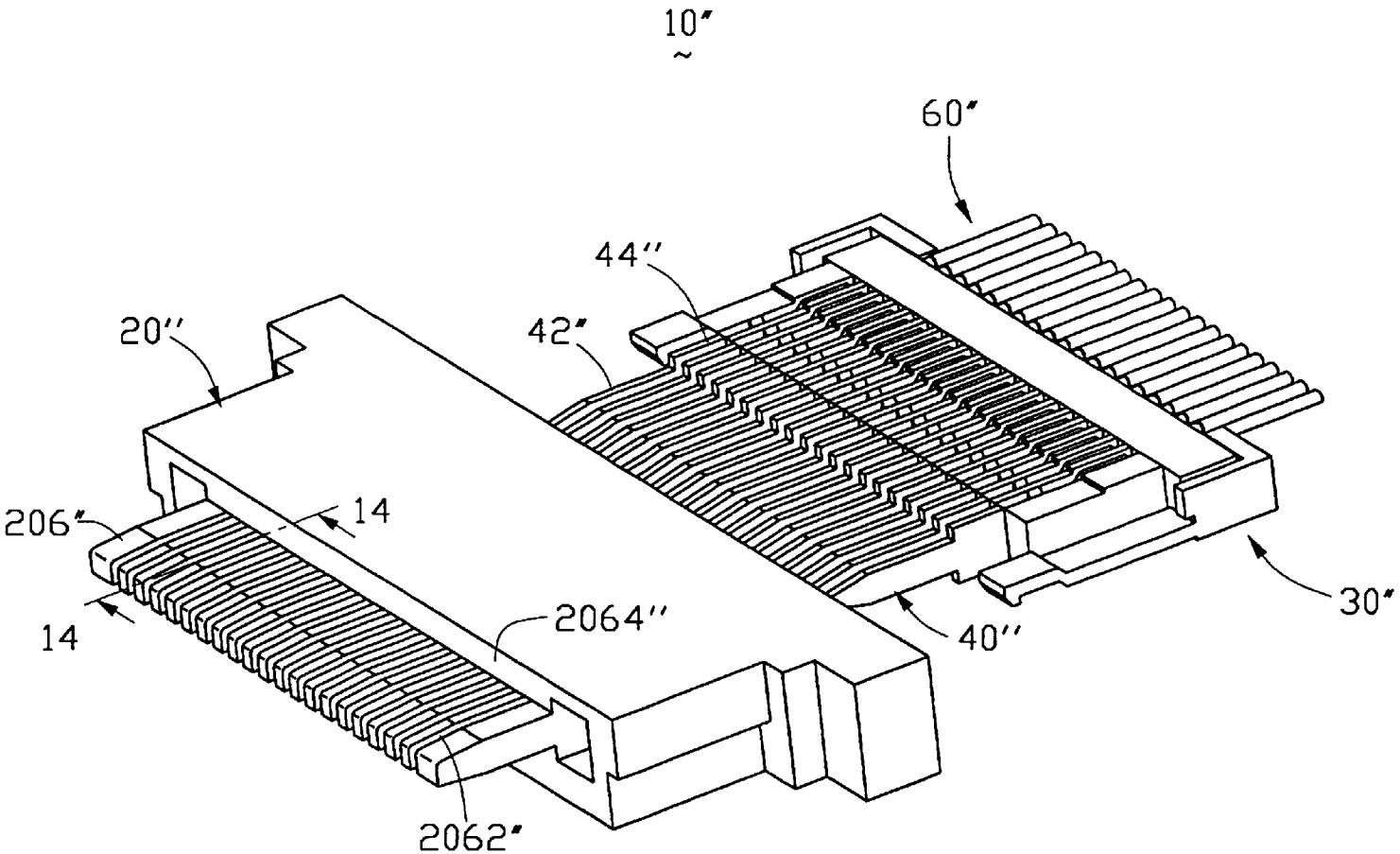
FIG. 13 shows a third embodiment of a micro connector assembly according to the present invention.
Figure 14:
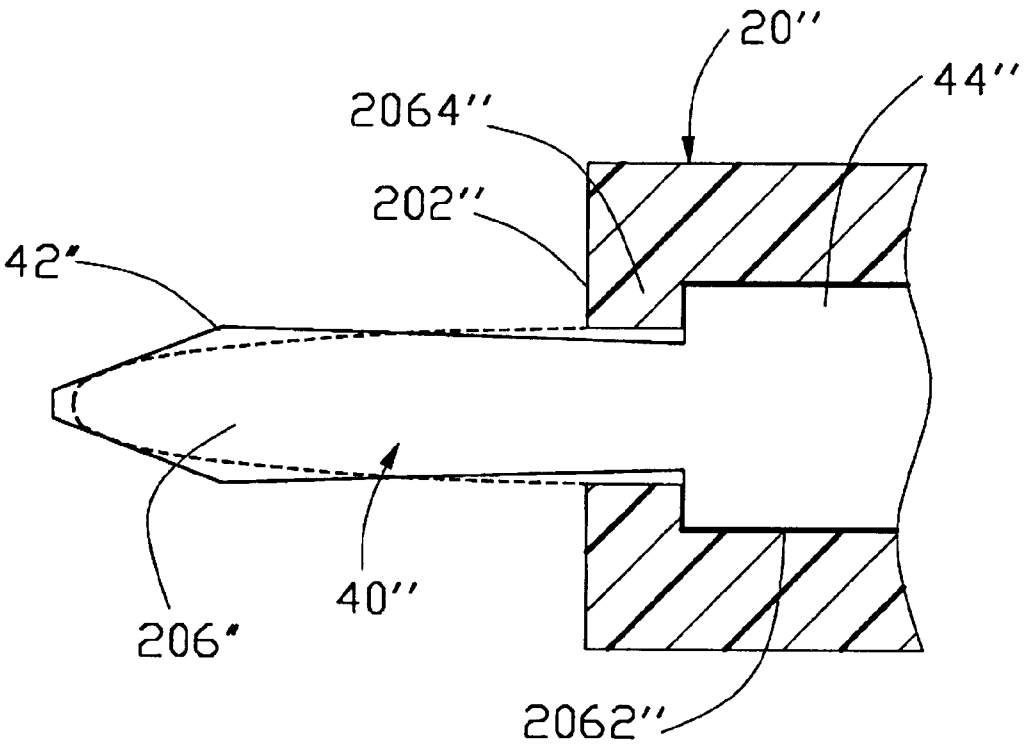
FIG. 14 is a partly cross-sectional view of the micro connector assembly taken along line 14—14 of FIG. 13.

A third embodiment of the present invention as shown in FIGS. 13 and 14 additionally forms a stopper wall 2064" on an outlet of each groove 2062" adjacent to the mating surface 202" of the front housing member 20". A shoulder of the first retention section 44" of the contact 40" can abut against the stopper wall 2064" as soon as being inserted into the corresponding groove 2062" thereby preventing the contacts 40" from removing out of the mating surface 202".

Figure 15:
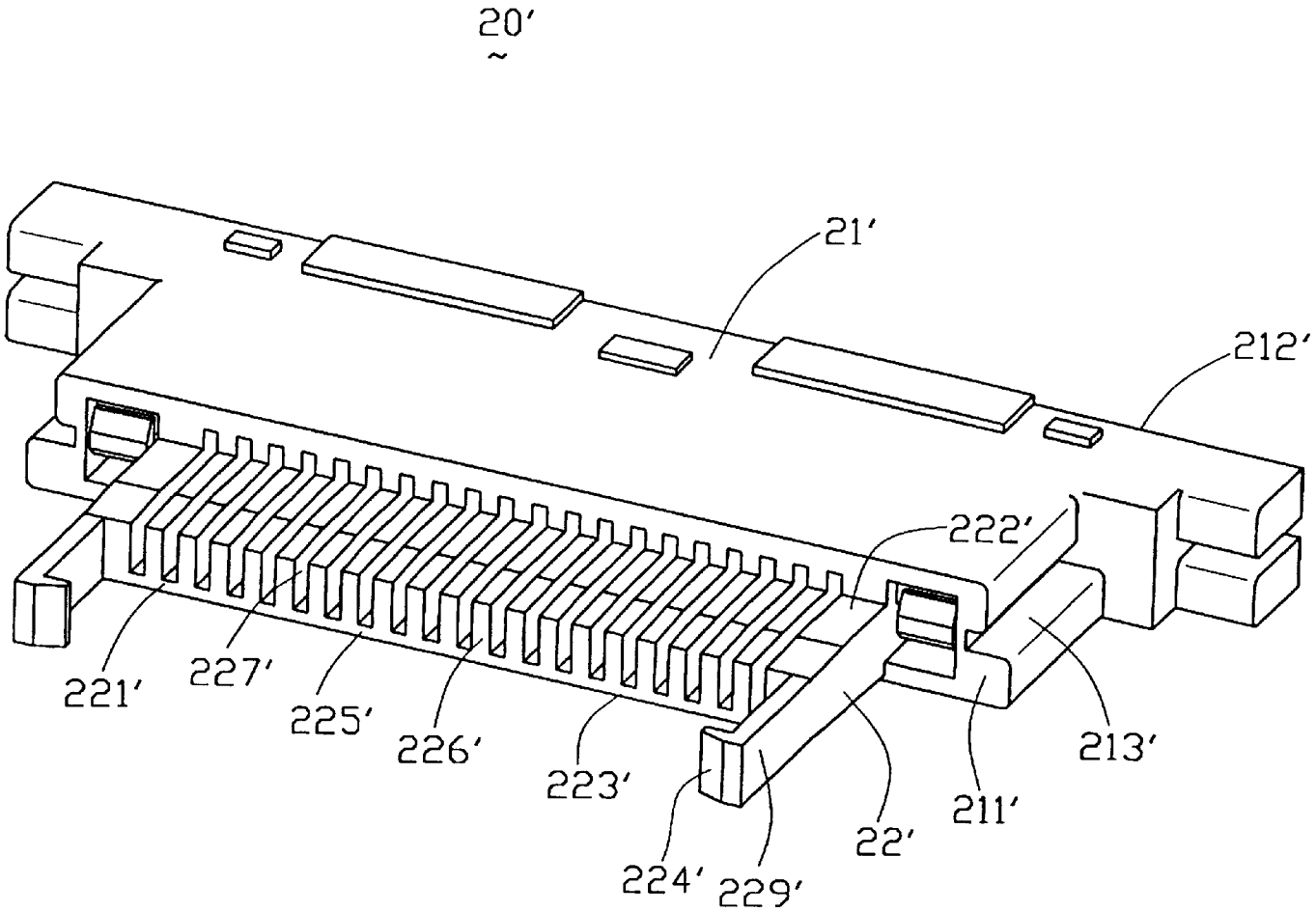
FIG. 15 shows a fourth embodiment of the front housing member according to the present invention.
Figure 16:
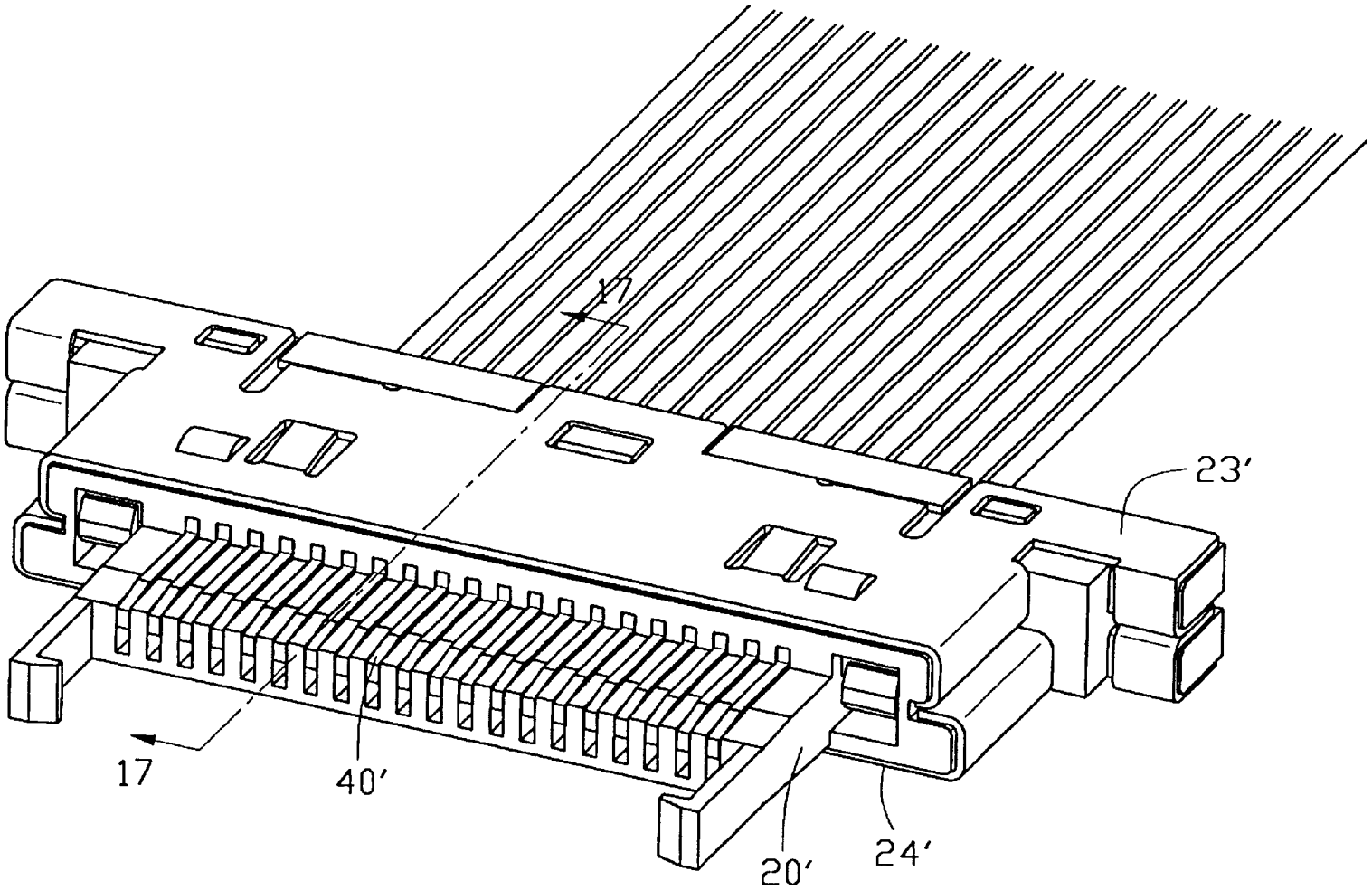
FIG. 16 shows a fourth embodiment of the micro connector assembly according to the present invention.
Figure 17:
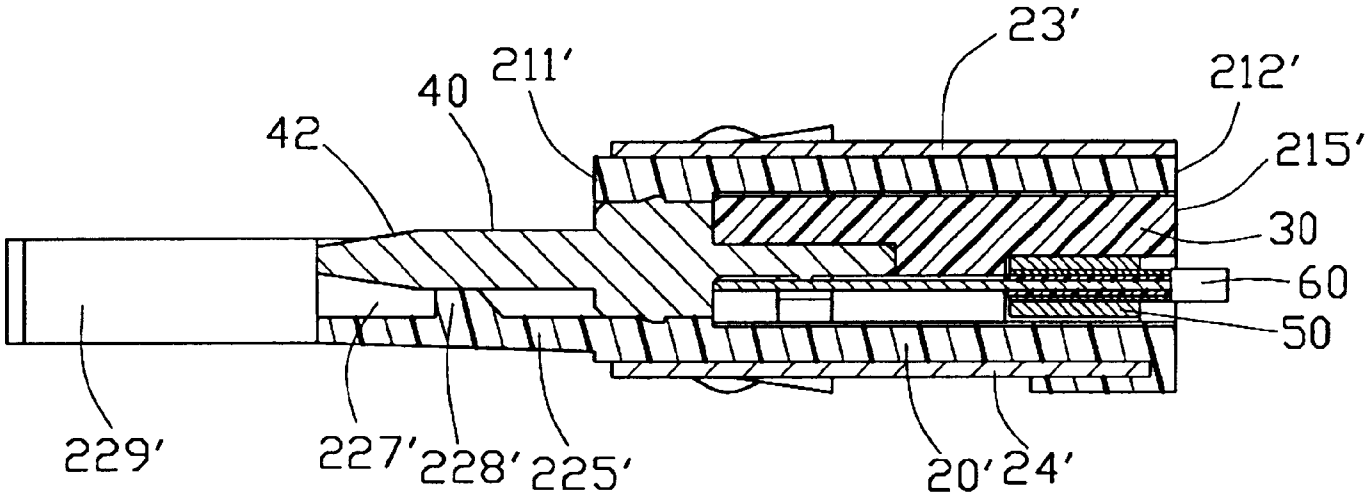
FIG. 17 is a cross-sectional view of the fourth embodiment of the micro connector assembly taken along line 17—17 of FIG. 16.

Referring to FIGS. 15–17, a fourth embodiment of the cable connector of the present invention is illustrated. The improvements of the fourth embodiment over the other embodiments mainly focus in the front housing 20' and upper and lower shields 23', 24' which are shown in FIGS. 16, 17. The front housing 20' comprises a body portion 21' having a mating surface 211' and a joint surface 212' at a front and a rear sides, and a tongue portion 22' forwardly extending beyond the mating surface 211' of the body portion 21'. The tongue portion 22' comprises a front surface 221', an upper surface 222' and a lower surface 223' opposing the upper surface 222'. A pair of locking arms 229' forwardly extend from opposite lateral ends of the tongue portion 22' beyond the front surface 221', each locking arm 229' having a hook 224' at a free end thereof for engageably locking to a mating connector. The tongue portion 22' comprises a bottom portion 225' adjacent to the lower surface 223' and a plurality of spacers 226' upwardly extending from the bottom portion 225' and terminating at the upper surface 222'. The front housing 20' defines a plurality of cavities 227' through the joint surface 212' and the front surface 221' of the tongue portion 22'. Each of the cavities 227' is defined with and enclosed by two adjacent spacers 226' and the bottom portion 225'. A block 228' (FIG. 17) protrudes upwardly from the bottom portion 225' into a corresponding cavity 227'. The body portion 21' defines two recesses 213' extending in the front to rear direction in opposite lateral walls thereof, respectively, for fixedly engaging opposite edges of the upper and lower shields 23', 24'. The body portion 21' further defines an opening 215' (FIG. 17) in the joint surface 212' thereof through which the subassembly of the rear housing 30, the contacts 40, the grounding bar 50 and the cables 60 as shown in FIGS. 5, 12 and 13 is engageably inserted into the front housing 20'.

Particularly referring to FIGS. 16, 17, after the subassembly is inserted into the front housing 20', the contact section 42 of each of the contacts 40 is enclosed by the two adjacent spacers 226' and the bottom portion 225'. In particular, bottom sections of the contact sections 42 are supported by the blocks 228' of the bottom portion 225', respectively, while top sections to the corresponding contact sections 42 extend beyond the upper surface 222' of the tongue portion 22'. The upper and lower shields 23', 24' are respectively shrouded to upper and lower surfaces of the body portion 21', lateral edges thereof are fixedly received in the opposite recesses 213', respectively.

Figure 18:
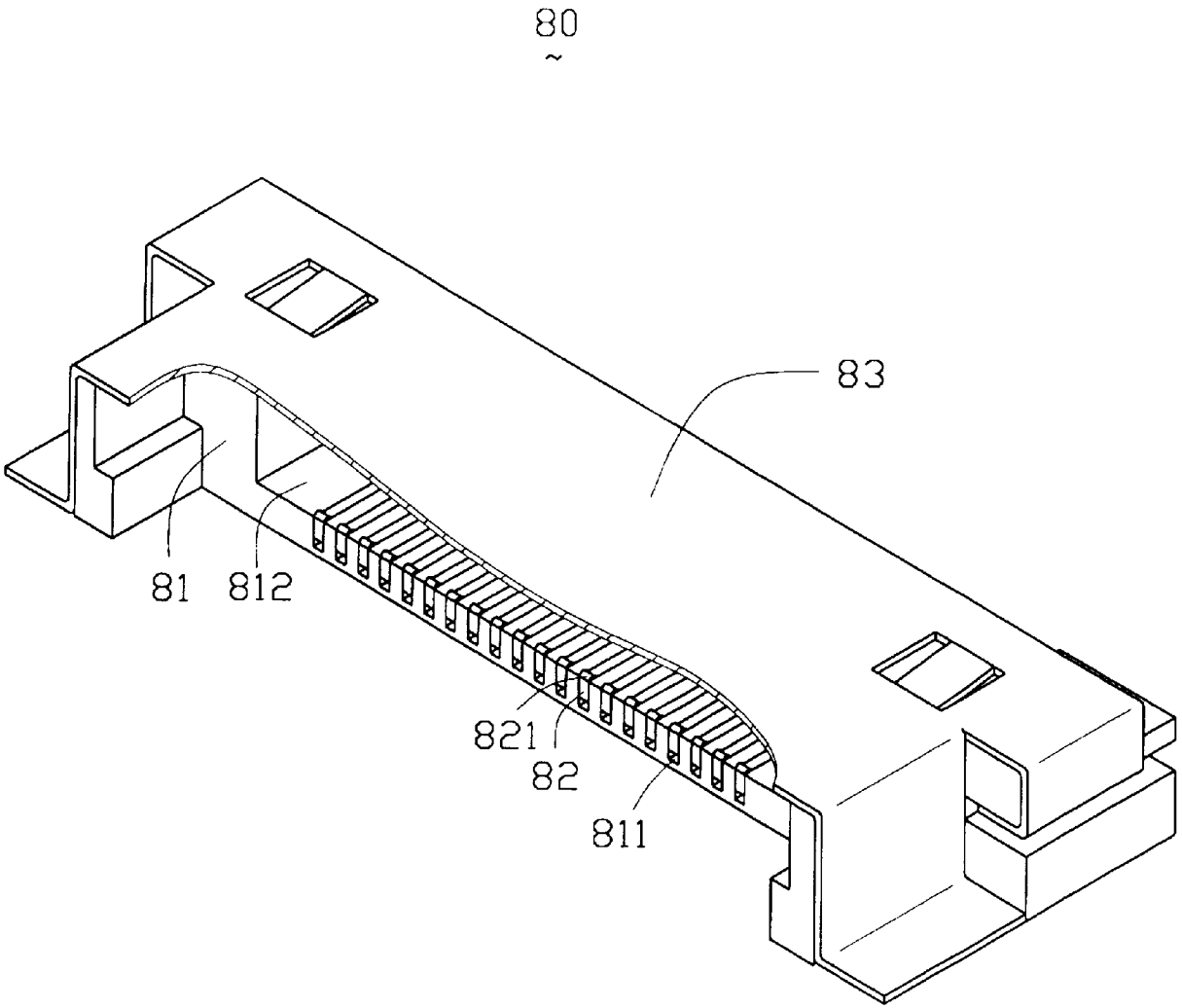
FIG. 18 is a front perspective view of a female connector that is matable with the micro connector assembly of the present invention while a part of a female shell of the female connector is cut away to clearly show contacts of the female connector.
Figure 19:
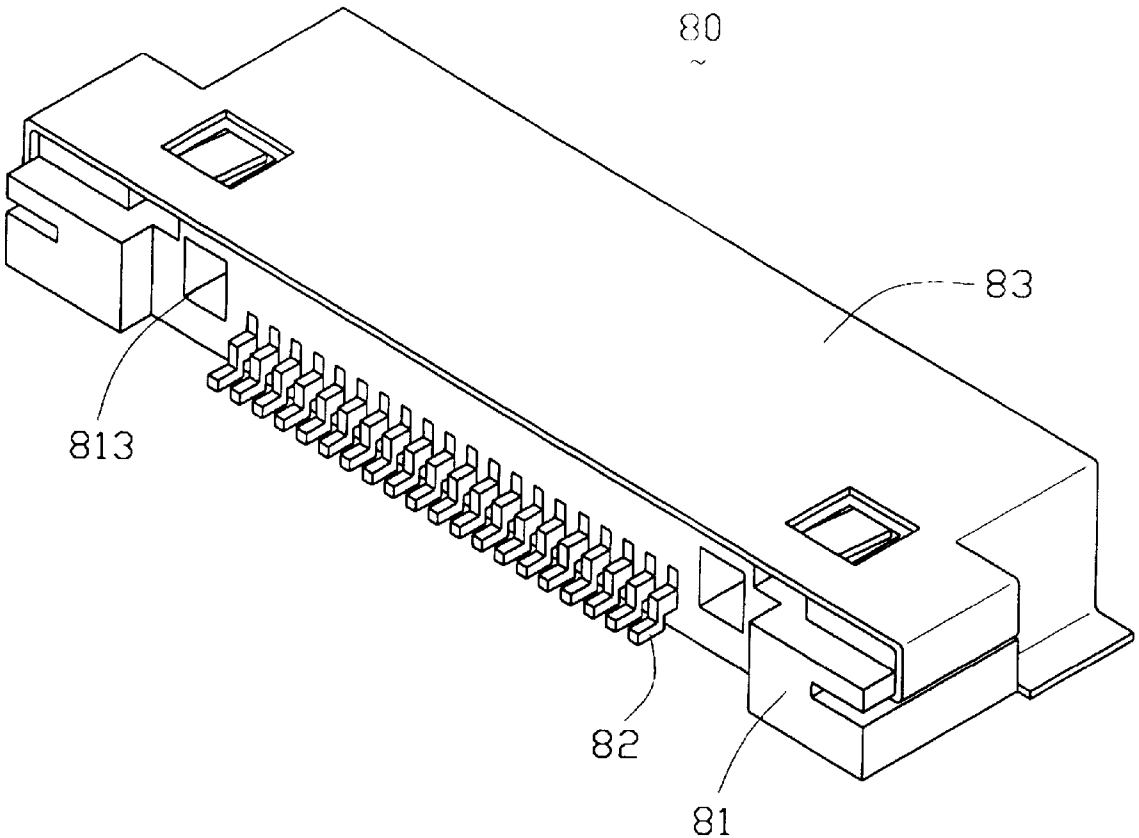
FIG. 19 is a rear perspective view of the female connector as shown in FIG. 18.

Referring to FIGS. 18, 19, a female connector 80 is illustrated. The female connector 80 comprises a female housing 81, a plurality of female contacts 82 received in the female housing 81 and a female shield 83 enclosing the female housing 81. The female housing 81 defines a plurality of apertures 811 through two opposite surfaces thereof in a front to rear direction in which the plurality of female contacts 82 are fixedly received, respectively. The female housing 81 further defines a chamber 812 in a front surface for fixedly receiving the tongue portion 22' of the cable connector. Each female contact 82 has a female contact section 821 partially extending from the corresponding aperture 811 into the chamber 812 for electrically engaging with the contact section 42 of the corresponding contact 40 of the cable connector. The female housing 81 further defines two windows 813 through the rear surfaces thereof adjacent to two outmost apertures 811 for fixedly receiving the pair of locking arms 229' of the cable connector.

Figure 20:
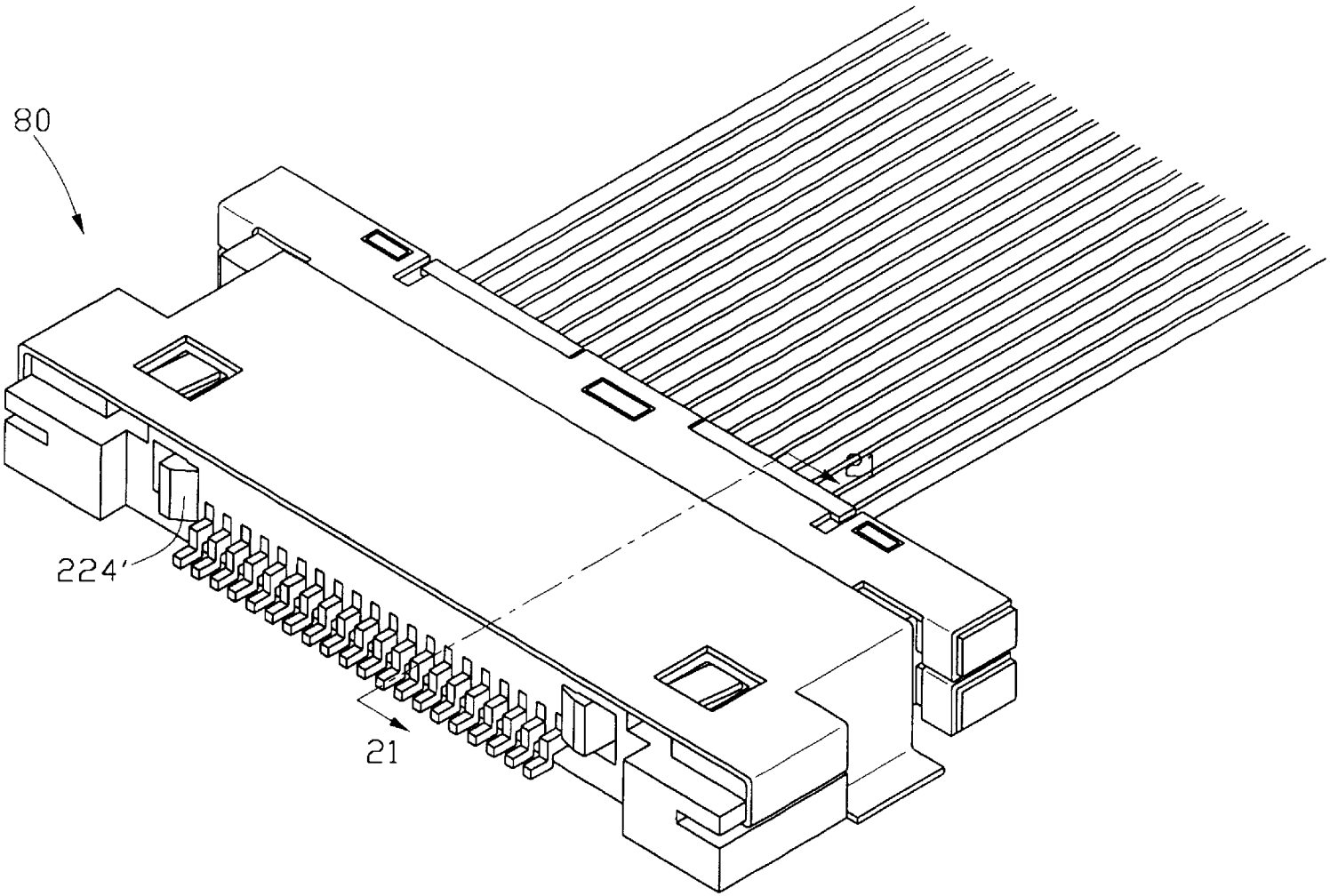
FIG. 20 is a perspective view of the assembly of the male and female connectors shown in FIGS. 16, 18 in a mating state.
Figure 21:
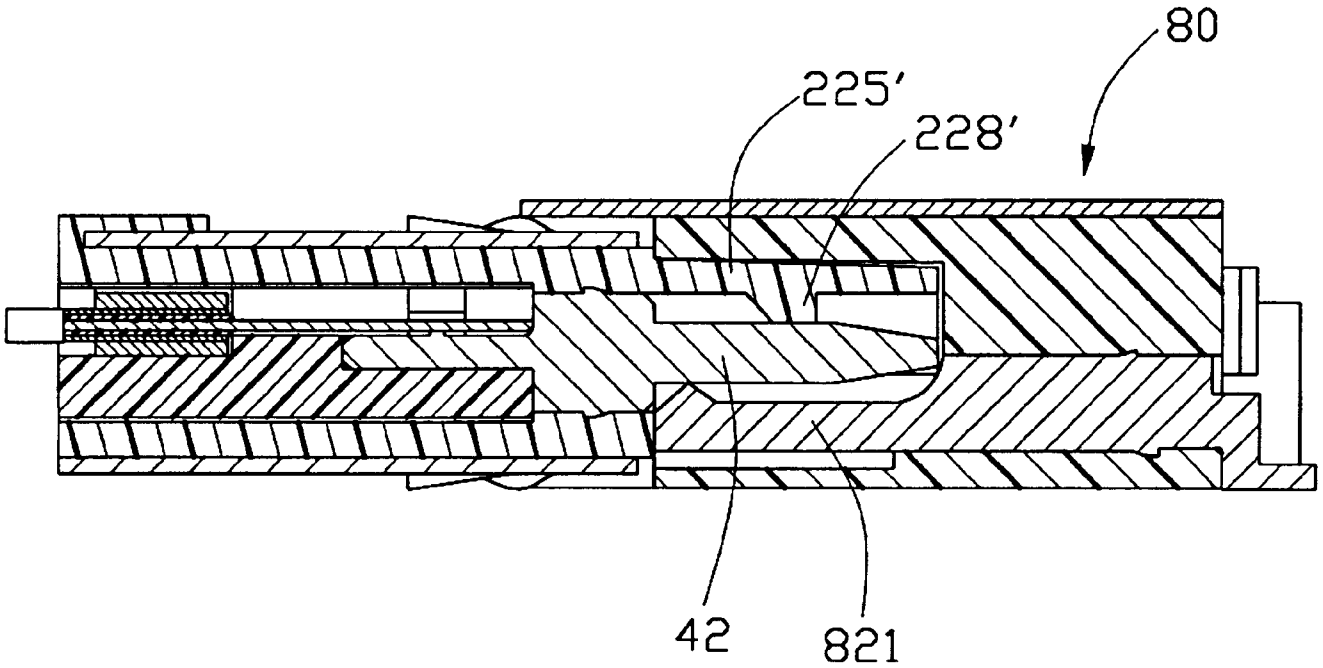
FIG. 21 is a cross-sectional view taken along line 21—21 of FIG. 20.

Referring to FIG. 20, after the cable connector completely mates with the female connector 80, the tongue portion 22' of the cable connector is fixedly received in the chamber 812 of the female connector 80 and the pair of locking arms 229' are fixedly received in the corresponding windows 813 while hooks 224' thereof hook the rear surface of the female housing 81. It should be understood that in another embodiment, a hidden engagement shoulder can be formed in the window so that the hook may be latchably engaged with such a shoulder and embedded within the window rather than be exposed on the rear surface. The contact sections 42' of the cable connector securely and electrically engage with the corresponding female contact sections 821 of the female connector 80 due to the urging of the blocks 228 acting on the contact sections 42 toward the contact sections 821. Therefore, in this embodiment, a more reliable electrical connection between the cable connector and the female connector 80 is attained. Furthermore, by the help of the locking arms 229' and the windows 813, the cable connector in accordance with the fourth embodiment can firmly connect with the female connector 80.

It is understandable that an external withdrawing force exercised on the cable connector cab be eliminated by the interference fit between the contacts and the housing and the locking between the latch portion and the bow section, rather than the tight fit between the contacts and the cable of the prior arts. Therefore, the electrical and mechanical connection between the contacts and cable is directly harmed.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

What is claimed is:

1. An electrical connector comprising:

a front housing member having a mating surface and a joint surface at a front and a rear sides thereof and a tongue portion forwardly extending beyond the mating surface, said tongue portion having a front surface, an upper surface, a lower surface opposite the upper surface and a bottom portion adjacent to the lower surface, said front housing member defining a plurality of cavities from the joint surface thereof to the front surface of the tongue portion, each cavity comprising a first segment defined in the tongue portion and a second segment defined between the mating and joint surfaces, the first segment open to the upper surface and terminating at the bottom portion of the tongue portion; and a plurality of contacts each having a contact section adapted for electrically engaging with a mating connector and a first retention section adjacent to the contact section, the contact section and the first retention section being received in the first and second segments of a corresponding cavity of the front housing member, respectively, wherein the contact section is supported by the bottom portion and partially extends beyond the upper surface of the tongue portion;

wherein the bottom portion of the tongue portion forms a plurality of blocks each protruding into the first segment of a corresponding cavity, each block bearing against the contact section of a corresponding contact;

wherein the front housing member further comprises a pair of locking arms forwardly extending from opposite lateral ends of the tongue portion, each locking arm forming a hook at a free end thereof adapted for engageably locking to a mating connector;

further comprising at least one shield shrouding the front housing member, wherein the front housing member respectively defines two recesses in opposite lateral walls thereof where lateral edges of the at least one shield are fixedly received;

further comprising: a plurality of juxtaposed cables each having at least a conductive signal segment at a free end thereof, and a rear housing member having a plurality of passageways in alignment with the cavities of the front housing member; wherein each passageway retentively receives the conductive signal segment of a corresponding cable and a tail section of a corresponding contact, said tail section electrically connecting the corresponding conductive signal segment of the corresponding cable; and wherein the front housing member defines an opening in the joint surface thereof through which the rear housing member is inserted therein;

wherein each of the contacts further includes a second retention section adjacent to the tail section which has an interference fit with the corresponding passageway for firmly retaining the contact therein;

wherein each of the passageways further forms at least a protrusion therein for cooperation with said second retention section of the contact;

wherein each of the passageways further forms a cavity at a bottom wall thereof for efficient reception of the tail section of the contact;

wherein each of the juxtaposed cables includes a grounding segment insulated from and adjacent to the signal segment, and a grounding bar is perpendicularly and fixedly jointed with the grounding segment of each of the cables;

wherein the rear housing member further forms a pair of spaced orientating walls adjacent to a rear surface of the rear housing member thereby forming an elongated slot for receiving the grounding bar joined with the cables therein;

wherein the front housing member further includes a pair of opposite channels extending through the mating and joint surfaces thereof, each channel forming a swelling therein, and said rear housing member further includes a pair of latch portions extending forwardly from the rear housing member to be inserted in the channels of the front housing member, each latching portion forming a bow section for cooperation with the swelling thereby reinforcing the retention between the first and rear housing members.

* * * * *